United States Patent [19]

Gorski

[11] Patent Number: 4,481,445

[45] Date of Patent: Nov. 6, 1984

[54] ELECTRON GUN FOR PROJECTION TELEVISION CATHODE RAY TUBES

[75] Inventor: Richard M. Gorski, Chicago, Ill.

[73] Assignee: Zenith Electronics Corporation, Glenview, Ill.

[21] Appl. No.: 383,444

[22] Filed: Jun. 1, 1982

[51] Int. Cl.[3] ..... H01J 29/46; H01J 29/56

[52] U.S. Cl. ..... 315/14; 313/449

[58] Field of Search ..... 315/14, 16, 31 R, 382; 313/449

[56] References Cited

U.S. PATENT DOCUMENTS 4,334,170 6/1982 Rockwell ..... 315/16

*Primary Examiner*—Theodore M. Blum

*Attorney, Agent, or Firm*—Cornelius J. O'Connor

[57] ABSTRACT

A high-performance bipotential-type electron gun comprises a series of electrodes aligned in spaced relation on an axis. The gun has in the order named lower end means including a cathode, and an apertured plate control electrode and grid electrode. An entry angle control electrode is located between the lower end electrodes and the main focus lens. The main focus lens includes a focusing electrode and a final accelerating electrode. The electron gun according to the invention is defined in terms of dimensions, electrical potentials and ratios thereof which are effective to provide an electron gun of particular suitability for use in projection cathode ray tubes.

4 Claims, 3 Drawing Figures

ELECTRON GUN FOR PROJECTION TELEVISION CATHODE RAY TUBES

CROSS-REFERENCE TO RELATED APPLICATION

This application is related to but in no way dependent upon copending application Ser. No. 079,926 filed Sept. 28, 1979, of common ownership herewith, which will issue June 8, 1982 as U.S. Pat. No. 4,334,170.

BACKGROUND OF THE INVENTION AND PRIOR ART STATEMENT

This invention relates generally to cathode ray picture tubes, and is specifically addressed to an electron gun for use in cathode ray tubes used in projection television systems in conjunction with associated projection lenses.

Projection television systems typically include at least one cathode ray picture tube having a cathodoluminescent screen on the inside surface of the face panel. Electron-beam generating means disposed on the cathode ray tube electron-optical axis provide for forming an electron image on the cathodoluminescent screen. This electron image is converted to a visible image by the screen. Projection lens means on the projection optical axis of the tube provide for projecting the aerial image of the visible image onto a viewing screen whereon the viewer sees the television picture. The viewing screen may be of the front-projection type, or of the rear-projection type wherein the aerial image is projected onto the side of the screen opposite the viewer. To provide for compactness of the projection system, the path of the aerial image is normally "folded" by means of one or more mirrors.

Projection television systems may have a bank of red, green and blue image source means including three cathode ray picture tubes each with an associated projection lens for projecting into coincidence a red, green, and blue image to form a composite color image on the viewing screen.

A desirable—indeed necessary—feature of a projection television system is the ability to project an image of adequate brightness on the viewing screen. Brightness preferably should be equal to that of the typical shadow mask color picture tube which provides an average brightness of 80 foot-Lamberts at a beam current of 1.5 milliamperes, and with a peak brightness potential of about 320 foot-Lamberts. In view of the relatively long projection path and consequent effect of the inverse-square law, this brightness objective has proved difficult to achieve in projection television systems.

The face of a cathode ray picture tube used in projection television systems can be circular, with a diameter of about six inches. Alternately, the face panel can be of rectangular configuration, with dimensions of approximately 4.5 inches in height, and 5.5 inches in width, by way of example. The visible image that is electron-formed on the cathodoluminescent screen on the inner surface of the face plate is a rectangle of three to four aspect ratio. To provide a projected image of four feet in diagonal measure having a brightness of eighty foot-Lamberts, for example, the brightness of the image onthe cathodoluminescent screen of the projection tube must be in the range of eight thousand to nine thousand foot-Lamberts.

Image brightness of this magnitude requires a relatively high beam current, typically about 1.5 milliamperes. High beam current in turn connotes a relatively large beam spot size on the imaging screen with consequent degradation of resolution. For example, attempting to increase image brightness by increasing beam current results in a loss of image resolution as beam diameter, and hence spot size, is in general proportional to the square root of the beam current. An increase in beam current from one milliampere to two milliamperes in a standard bipotential gun, for example, will normally increase spot size by about forty percent. And the larger the beam spot size, the lower the resolution. Hence an electron gun for use in a projection television cathode ray tube must be able to form a relatively small beam spot while operating at relatively high beam currents.

Electron guns used in television picture tubes generally consist of two basic parts: (1) an electron beam source, and (2) a lens for focusing the electron beam on the phosphor screen of the cathode ray tube. Most commercial focus lenses are electrostatic and consist of discrete, conductive, tubular elements which are arranged in sequence on an axis. These electrodes are supplied with predetermined voltages which establish the electrostatic focusing field. A main objective in designing an electron gun is to produce a small, symmetrical beam spot on the cathodoluminescent screen of the tube. The electron beam focus lens of the novel electron gun according to the present invention is classifiable as a bipotential, and consists of two electrodes. The first is the focus electrode and the second electrode is a beam accelerating electrode.

The present invention is disclosed in referent copending application Ser. No. 079,926. My invention was included in the application to indicate an environment for the '926 invention, which is directed to a half angle control electrode (see reference No. 138 in FIG. 10 of the '926 disclosure).

OBJECTS OF THE INVENTION

It is a general object of this invention to provide an optimally performing electron gun for use in projection television cathode ray tubes.

It is a less general object of the invention to provide an electron gun for projection television cathode ray tubes capable of providing high image brightness without serious loss of resolution.

It is a more specific object of the invention to provide an electron gun exhibiting minimum increase in spot size when beam current is greatly increased.

It is a specific object of the invention to provide an electron gun capable of providing maximum brightness with high resolution.

It is another specific object of the invention to provide an electron gun having a long operating life when operated at maximum beam currents.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, in which:

DESCRIPTION OF THE PREFERRED EMBODIMENT

Figure 1:
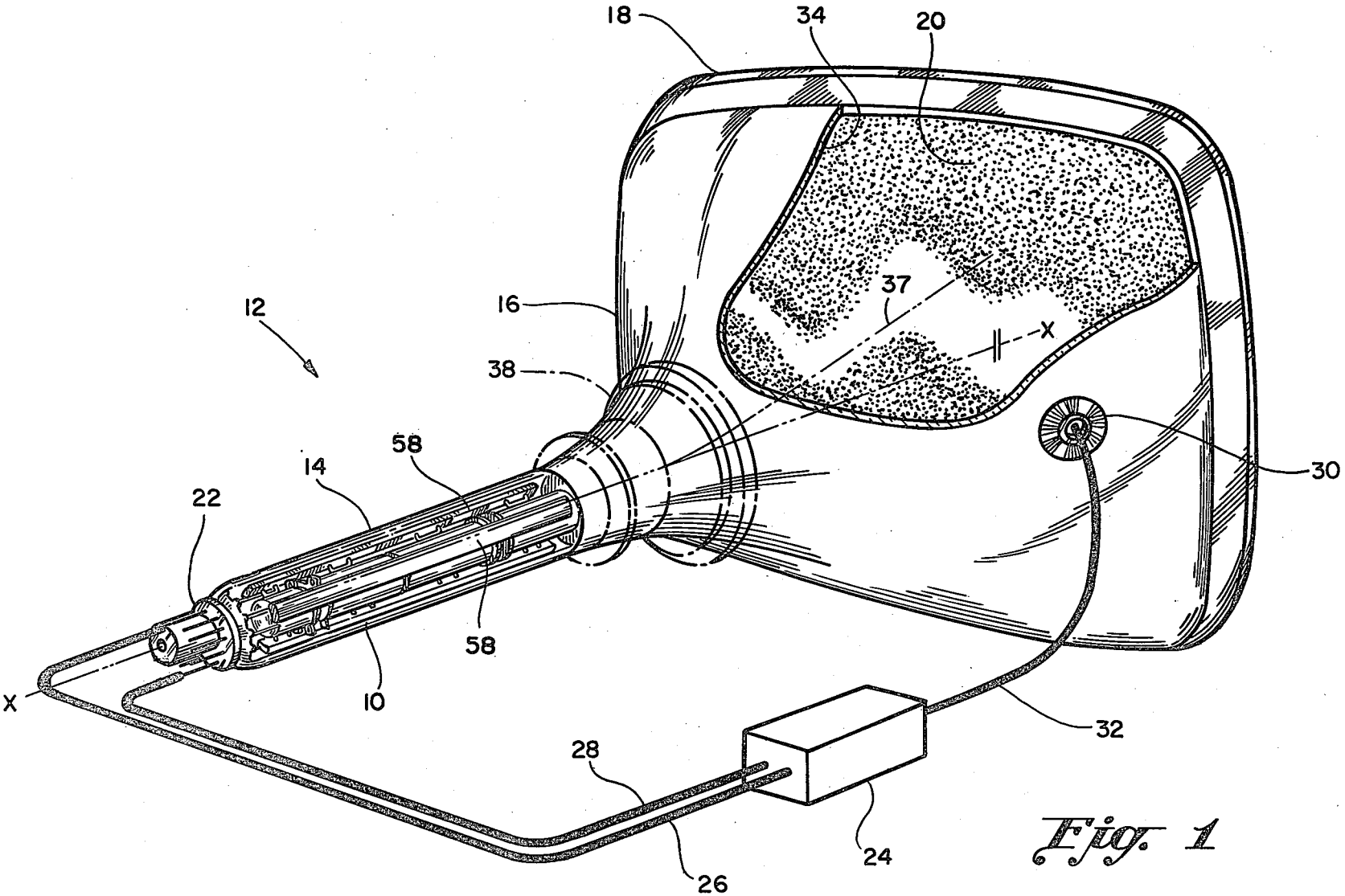
FIG. 1 is a view in perspective of an electron gun according to the invention as installed in a projection cathode ray tube depicted as being partly cut away.

A high-performance electron gun 10 according to the invention is shown in FIG. 1 as installed in a cathode ray tube 12 for use in a projection television system, by way of example. The electron gun according to the invention is not limited to projection tube applications, but can be used in other cathode ray tube type systems requiring very small beam spots.

The relationship of the electron gun 10 according to the invention with the projection tube 12 is indicated by FIG. 1. The primary components of picture tube 12 comprise an evacuated glass envelope including a neck 14, a funnel 16, and a face panel 18. On the inner surface of face panel 18 there is indicated a cathodoluminescent imaging screen 20. The electron gun according to the invention is indicated as being located within neck 14 substantially as shown. Gun 10 is normally installed in alignment with the axis X—X of tube 12.

Power supply 24, also indicated schematically, is associated with cathode ray tube 12 for developing a predetermined pattern of supply voltages for gun 10 and tube 12. A special voltage divider circuit is typically incorporated in the power supply to provide a range of potentials required for tube and gun operation. For example, power supply 24 supplies a relatively low voltage of about 1,900 volts through an electrical conductor 26 depicted schematically as being connected to one of the pins indicated as extending from base 22. Power supply 24 also provides a relatively intermediate voltage of approximately 7,000 volts through another conductor 28 indicated schematically as being connected to another pin extending from tube base 22.

Power supply 24 also provides a relatively high voltage of about 30,000 volts to anode button 30 through a conductor 32. Anode button 30 in turn introduces the relatively high voltage through the funnel 16 to make internal contact with thin, electrically conductive coating 34 disposed on the inner surface of funnel 16, and extending part way into neck 14. An accelerating electrode of gun 10 receives the relatively high voltage through a plurality of gun centering springs extending from gun 10, and in physical contact with inner conductive coating 34.

Gun 10 is depicted in this example as emitting a single electron beam 37 for scanning the cathodoluminescent screen 20. Scanning of the beam is accomplished by means of a deflection yoke 38, indicated schematically as encircling neck 14 and extending part way onto funnel 16.

Cathodoluminescent screen 20 normally comprises, in projection television cathode ray tubes, an homogeneous deposit of one of three types of phosphor emitting red, green or blue light under bombardment of electron gun 10.

Figure 2:
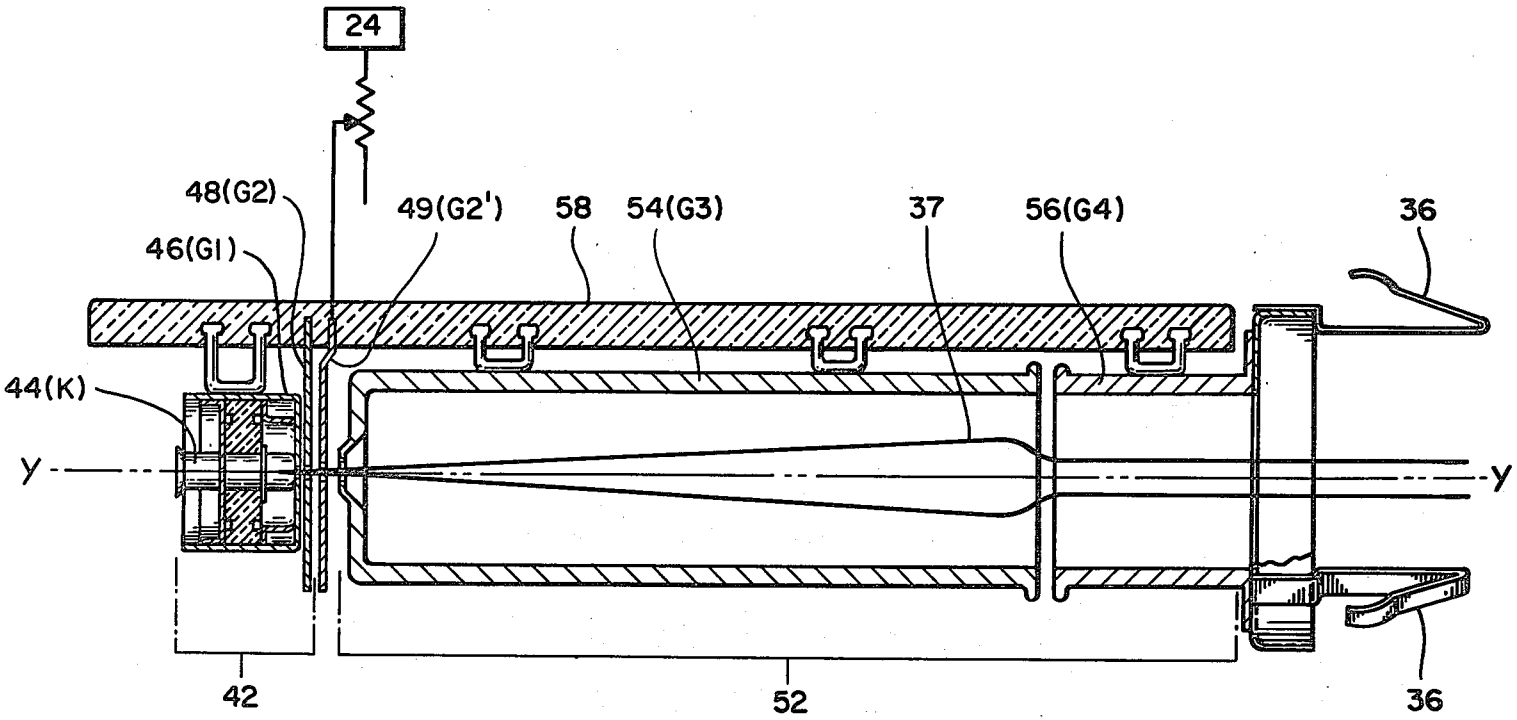
FIG. 2 is a longitudinal elevation in section showing details of an electron gun according to the invention depicted in FIG. 1.
Figure 3:
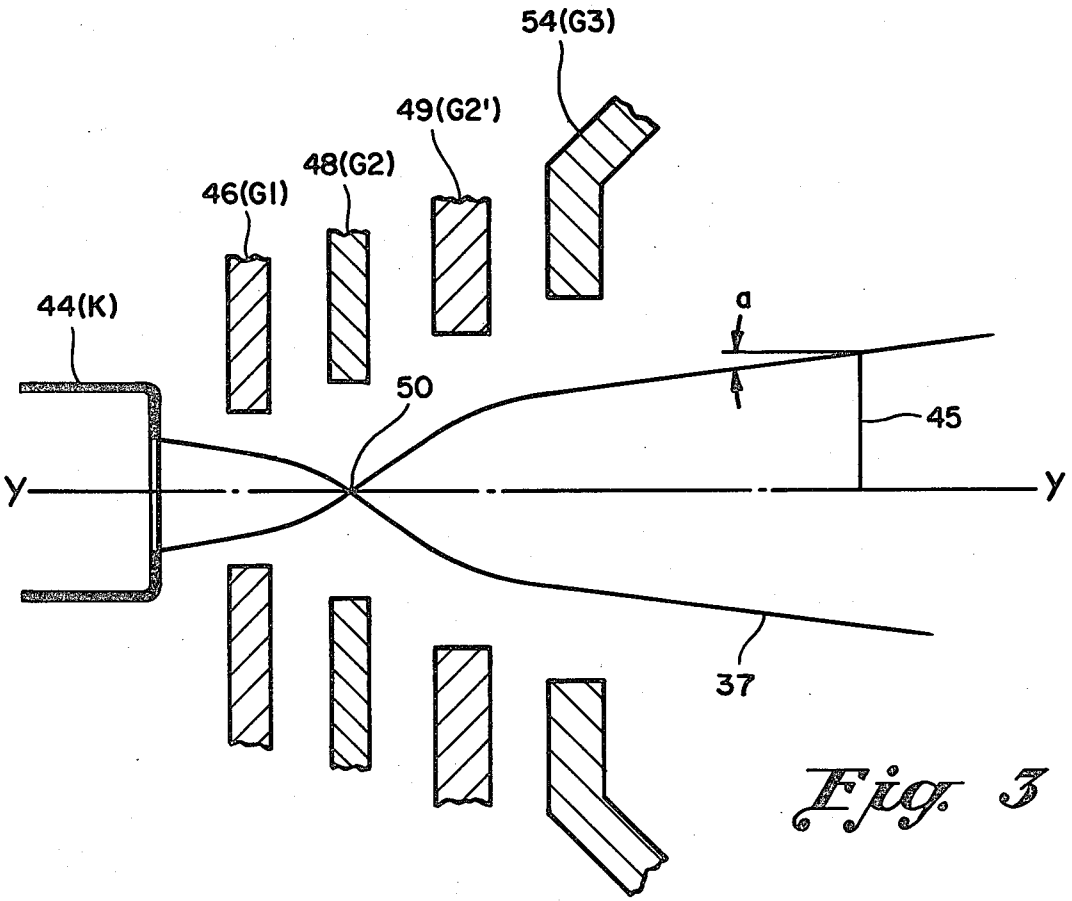
FIG. 3 is a diagram in profile of a section of an electron beam in which is indicated schematically a beam entry angle defined with respect to the axis on the beam.

FIG. 2 is a detail view of a preferred embodiment of the electron gun 10 according to the invention, and FIG. 3 indicates the profile of the beam as formed in the lower end of the gun 10. Gun 10 is depicted as having a series of apertured electrodes aligned in spaced relation on an axis Y—Y for receiving the aforedescribed predetermined voltages from power supply 24 to produce a finely focused beam of electrons on screen 20. Gun axis Y—Y is substantially congruent with the axis X—X of tube 12. The electron gun according to a preferred embodiment of the invention comprises the following components in the order named.

Lower end means 42, indicated by the bracket, has a cathode 44 (K) for developing the electron beam 37. The cathode 44 potential at cut-off is in the range of 125–220 volts. Lower end means 42 further includes one apertured plate control electrode 46 (G1) having a zero volt potential thereon, and at least one (shown as being one) apertured plate cut-off electrode 48 (G2) for forming, in conjunction with the cathode 44, electron beam 37. An entry angle control electrode 49 (G2′) is indicated as following electrode 48. An apertured plate electrode consists of a plate such as a disk or rectangle having an aperture therethrough; this is in contradistinction to the "cylinder" electrode which is tubular, and which is used in the main focusing lens.

Electrode 48 receives a potential in the range of 1,200–2,200 volts, and preferably about 1,900 volts with the cathode 44 at 190 volts cut-off. Electrode 49, the entry angle control electrode, receives an adjustable potential in the range of −500 to +500 volts, and preferably a potential of about 220 volts to provide an optimum entry angle.

Electrode 48 receives the aforedescribed low voltage of about 1,900 volts (with cathode 44 at 190 volts cut-off) from power supply 24 for developing, in conjunction with control electrode 46, a crossover 50 in beam 37, the general location of which is in the aperture of electrode 48. Entry angle control electrode 49 is indicated schematically as receiving an adjustable voltage from power supply 24 for adjustment of the entry angle.

Main focus lens means 52, indicated by the bracket, provides for receiving, focusing and accelerating beam 37. Main focus lens 52 includes cylindrical focusing electrode means 54 (G3) for receiving, in the preferred embodiment of the invention, a beam focusing voltage in the range of 4,700 volts to 7,600 volts, and preferably, about 7,110 volts from power supply 24 for focusing a beam spot of minimum size on screen 20.

Main focus lens means 52 also includes a cylindrical accelerating electrode means 56 (G4) for receiving the relatively high beam accelerating voltage in the range of 20,000–32,000 volts, and preferably, 30,000 volts, for example, from power supply 24 for accelerating beam 37. The ratio of the potentials of the voltage on the focusing electrode 54 and the voltage on the accelerating electrode 56 is in the range of 0.22 to 0.254, and preferably about 0.24.

Gun centering springs 36 extend from accelerating electrode 56 to make contact with the inner conductive coating 34. The cathode assembly and the electrodes G1–G4 are indicated as being fixed in proper relationship and alignment by multiform glass beads; one such bead 58 is depicted in FIG. 2. Three sets of centering springs 36 and three beads 58 are normally used in each gun, located 120 degrees apart.

Beam spot size of the gun according to the invention is specified as being approximately 13 mils or less. Beam spot size is defined as the diameter from edge-to-edge of the beam expressed in mils at a landing point on screen 20, typically at center screen. The "edge" of a beam is defined as those points near the circumference of the beam where the current density due to fall-off is only thirty percent of the peak density at the center of the beam. The electron gun according to the invention forms a beam spot having the diameter of approximately 13 mils or less on the screen 20 at a "throw" distance of about 4.9 inches when the gun is mounted in a projection cathode ray tube. This approximately 13 mil spot size is noted as being produced at a beam current of about 1.5 milliamperes at the best focus center. It is to be noted that this spot size is obtained under conditions wherein the cathode 44 cut-off voltage is 190, and the voltage on the accelerating electrode 56 is about 30,000.

An electron beam diverging from the cross-over defines a "half angle" with respect to the axis of the gun. The half angle is essentially a measure of beam growth in diameter as the beam diverges from the cross-over. The half angle is variously termed a "semi-angle" or a "divergence angle". In this disclosure, half angle is designated by the more descriptive term "entry angle" as it denotes the angle of the beam envelope upon its entry into the main focus lens.

An entry angle and means for its measure are indicated schematically in FIG. 3. The cathode 44 (K) is indicated as emitting a stream of electrons which is formed into the beam 37. A cross-over 50 is formed from which beam 37 defines an angle $\alpha$ with respect to the axis Y—Y of the electron gun. Angle $\alpha$ is measured from a selected "cut line" 45, which is located approximately one to three aperture diameters into electrode 54 where there exists an essentially field-free region.

The magnitude of an entry angle depends generally on the electro-mechanical design parameters of the lower end section of the electron gun. The factors that normally affect formation on the cross-over 50 and subsequent prefocusing of the beam prior to its entry into the main focus lens, and the resultant entry angle, include the configuration of the first and second electrodes 46 and 48; spacing between the cathode 44 and the first electrode 46, between the first and second electrodes 46 and 48, between the second electrode 48 and the following electrode 54 of the main focus lens 52; aperture sizes; and the configurations of the electrodes as designed to establish the prefocusing fields. The half-angle is established essentially by the difference in potential of the electrodes of the lower end 42, the spacing between the electrodes, and the diameters of the electrode apertures. However, the angle can also be definitively adjusted by entry angle control electrode 44 (G2').

It is essential in electron gun design, whether the gun be a bipotential or other, that the beam entry angle and apparent source position be of the proper value so that the beam will optimally fill the main focus lens. If this optimum filling is accomplished, the total effect from spherical aberration, object magnification and space charge repulsion will be minimized, and a beam spot of minimum diameter will be focused on the screen 20.

As has been noted, the electron gun 10 according to the invention has an entry angle control electrode 49 (G2') located in the region between the lower end 42 and main focus lens 52. Electrode 49 receives an adjustable potential in the range of −500 to +500 volts, and preferably about 220 volts. The entry angle control electrode 49 ("half-angle" control electrode) is fully described and claimed in U.S. Pat. No. 4,334,170, of common ownership herewith.

The preferred embodiment of the electron gun according to the invention is defined in terms of certain dimensions, electrical potentials, and ratios thereof set forth in this disclosure and in greater detail in following paragraphs, which characterize the inventive combination. The factors include the number of electrodes, their general configuration, and their sequence. With respect to the aperture electrodes of the lower end 42 and their dimensions, the invention resides in electrode spacings, aperture diameters, and electrode thicknesses at the apertures. For cylinder electrodes of the main focus lens 52, the factors are the axial lengths and lens diameters.

The preferred embodiment of the invention is further defined by the electrode potentials, expressed both as a range, and more specifically. The synergistic combination of dimensions, potentials and ratios thereof is effective to provide an electron gun of particular suitability for use in projection cathode ray tubes, one capable of providing maximum image brightness with minimum degradation of image resolution due to beam blooming.

| | |
|---|---|
| K-G1 spacing (cold) | 0.007 |
| G1 aperture diameter | 0.025 |
| G1 thickness, at aperture | 0.007 |
| G2 aperture diameter | 0.036 |
| G2 thickness, at aperture | 0.006 |
| G1–G2 spacing | 0.007 |
| G2' aperture diameter | 0.054 |
| G2' thickness at aperture | 0.012 |
| G2–G2' spacing | 0.030 |
| G3 aperture diameter | 0.065 |
| G3 thickness at aperture | 0.010 |
| G3 axial length | 1.75 |
| G3 lens diameter | 0.437 |
| G4 axial length | 0.70 |
| G4 lens diameter | 0.437 |
| G3–G4 spacing | 0.060 |
| Gun length | 2.60 |

The electron gun according to the preferred embodiment of the invention operates with the following approximate range of electrical potentials:

| | |
|---|---|
| K potential (at cut-off) | 125 to 220 |
| G1 potential | 0 |
| G2 potential (with K between 125–220 volt cut-off) | 1,200 to 2,200 |
| G2' potential | −500 to +500 |
| G3 potential | 4,700 to 7,600 |
| G4 potential | 20,000 to 32,000 |

The electron gun according to the preferred embodiment of the invention operates with the following electrical potentials:

| | |
|---|---|
| K potential (at cut-off) | 190 |
| G1 potential | 0 |
| G2 potential, (at 190 volt K cut-off) | 1,900 |
| G2' potential | +220 |
| G3 potential | 7,110 |
| G4 potential | 30,000 |

The gun length, as measured from the surface (G2 side) of electrode 46 to the end of the accelerating electrode 56 is noted as being about 2.60 inches. The "throw distance"; that is, the distance from the accelerating electrode 56 to the landing point of beam 37 at the center of screen 20 is about 4.9 inches.

The electron gun according to a preferred embodiment of the invention is characterized by having the following approximate ratios:

a G3 lens diameter to G3 length ratio of about 0.25;

a G3 electrode potential to G4 electrode potential ratio of about 0.24;

a gun length to throw distance ratio of about 0.53;

a G3 electrode length to gun length ratio of about 0.68;

a G2' electrode potential to G2 electrode potential ratio of about 0.12.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

I claim:

1. A high-performance bipotential-type electron gun comprising a series of electrodes aligned in spaced relation on an axis, having in the order named, lower end means including a cathode (K), and an apertured plate control electrode (G1), a grid electrode (G2), an entry angle control electrode (G2'); and a cylindrical electrode focus lens means including a focusing electrode (G3), and a final accelerating electrode (G4), said electron gun having the following approximate dimensions and spacings:

| | |
|---|---|
| K-G1 spacing (cold) | 0.007 |
| G1 aperture diameter | 0.025 |
| G1 thickness, at aperture | 0.007 |
| G2 aperture diameter | 0.036 |
| G2 thickness, at aperture | 0.006 |
| G1-G2 spacing | 0.007 |
| G2' aperture diameter | 0.054 |
| G2' thickness at aperture | 0.012 |
| G2-G2' spacing | 0.030 |
| G2'-G3 spacing | 0.030 |
| G3 aperture diameter | 0.065 |
| G3 thickness at aperture | 0.010 |
| G3 axial length | 1.75 |
| G3 lens diameter | 0.437 |
| G3-G4 spacing | 0.060 |
| G4 axial length | 0.70 |
| G4 lens diameter | 0.437 |

-continued

| | |
|---|---|
| Gun length | 2.60 |

2. The electron gun of claim 1 for operation with the following approximate ranges of electrical potentials, as expressed in volts:

| | |
|---|---|
| K potential (at cut-off) | 125 to 220 |
| G1 potential | 0 |
| G2 potential (with K between 125-220 volt cut-off) | 1,200 to 2,200 |
| G2' potential | −500 to +500 |
| G3 potential | 4,700 to 7,600 |
| G4 potential | 20,000 to 32,000 |

3. The electron gun according to claim 1 for operation with the following approximate electrical potentials, as expressed in volts:

| | |
|---|---|
| K potential (at cut-off) | 190 |
| G1 potential | 0 |
| G2 potential, at 190 volt K cut-off | 1,900 |
| G2' potential | 220 |
| G3 potential | 7,110 |
| G4 potential | 30,000 |

4. A high performance electron gun comprising a series of apertured electrodes aligned in spaced relation on an axis including an entry angle control electrode (G2') and cylindrical main focus lens electrodes in the order named, a focus electrode (G3), and an accelerating electrode (G4), said gun being characterized by having the following approximate ratios:

a G3 lens diameter to G3 length ratio of about 0.25;

a G3 electrode potential to G4 electrode potential ratio of about 0.24;

a gun length to throw distance ratio of about 0.53;

a G3 electrode length to gun length ratio of about 0.68; and a G2' electrode potential to G2 electrode potential ratio of about 0.12.

* * * * *